US008382426B2

(12) United States Patent
Itoh et al.

(10) Patent No.: US 8,382,426 B2
(45) Date of Patent: Feb. 26, 2013

(54) HIGH-SPEED AIR SPINDLE

(75) Inventors: Koushi Itoh, Tokyo (JP); Hirokatsu Shinohara, Tokyo (JP); Tomoaki Murata, Tokyo (JP)

(73) Assignees: Koushi Itoh (JP); Shinohara Industry Inc. (JP); Tomoaki Murata (JP)

( * ) Notice: Subject to any disclaimer, the term of this patent is extended or adjusted under 35 U.S.C. 154(b) by 1363 days.

(21) Appl. No.: 12/078,809

(22) Filed: Apr. 4, 2008

(65) Prior Publication Data

US 2009/0252594 A1 Oct. 8, 2009

(51) Int. Cl.
*F01D 1/16* (2006.01)
*F01D 15/06* (2006.01)

(52) U.S. Cl. ..... 415/143; 415/202; 415/904; 416/175; 416/198 R

(58) Field of Classification Search ..... 415/143, 415/202, 904; 416/175, 198 R, 201 A, 201 R; 433/103, 132
See application file for complete search history.

(56) References Cited

U.S. PATENT DOCUMENTS 2,724,134 A * 11/1955 Perlotto ..... 408/130
3,175,293 A * 3/1965 Borden ..... 433/82
3,381,378 A * 5/1968 Lawrence et al. ..... 433/127
RE28,390 E * 4/1975 Staunt ..... 433/132
3,952,416 A * 4/1976 Lingenhole ..... 433/82
4,566,849 A * 1/1986 Flink ..... 415/92
4,934,040 A * 6/1990 Turchan ..... 29/566
5,902,108 A * 5/1999 Nakayama et al. ..... 433/132
5,934,385 A * 8/1999 Svensson ..... 173/177
6,273,718 B1 * 8/2001 Schwenoha ..... 433/132
6,336,790 B1 * 1/2002 Jacobsson ..... 415/189
6,676,374 B2 * 1/2004 Hashimoto et al. ..... 415/202
7,927,101 B2 * 4/2011 Takashi et al. ..... 433/132

FOREIGN PATENT DOCUMENTS

JP 11-013753 A 1/1999

* cited by examiner

*Primary Examiner* — Edward Look
*Assistant Examiner* — Sean J Younger
(74) *Attorney, Agent, or Firm* — Smith Patent Office

(57) ABSTRACT

A high-speed air spindle including a spindle 1 supported by a first bearing 3 at the leading end side in the axial direction and a second bearing 2 at the rear end side, a driving air turbine 4 fixed in a spindle portion between the first bearing 3 and the second bearing 2, a speed-increasing air turbine 5 fixed in a spindle portion ahead of the first bearing 3, and an air passage 9 of an exhaust of compressed air supplied in the driving air turbine 4, flowing in the sequence of the first bearing 3 and the speed-increasing air turbine 5.

7 Claims, 11 Drawing Sheets

HIGH-SPEED AIR SPINDLE

BACKGROUND OF THE INVENTION

1. Field of the Invention

The present invention relates to a high-speed air spindle capable of rotating a spindle at a high speed exceeding 200,000 rpm.

2. Discussion of the Related Art

A machine tool having a high-speed spindle is used in high-precision cutting and machining in die fabrication of, for example, a portable telephone or a camera. The high-speed spindle is available as an air spindle driven by a compressed air, and an electric motor spindle driven by an electric motor. In particular, the air spindle (a) does not operate an electric motor, and is hence free from heat generation source, and is capable of machining at a high speed of about 80,000 rpm stably without being accompanied by thermal distortion, (b) and is small in the number of parts, and small in tool run-out due to imbalance in high-speed rotation, (c) rotates the spindle at a high speed, and is free form change in the depth of cut due to thermal distortion, and is easy in machining in a small diameter, and (d) is small in rotating noise, and has many other features, and it is favorably used in small-diameter machining where cutting and machining of high precision are demanded.

A conventional air spindle is shown, for example, in FIG. 14, in which a spindle 101, having a machining tool 103 for cutting and grinding fixed to the leading end, and an impulse turbine 102 fixed nearly in the center of the spindle, is supported by bearings not shown. In this air spindle 100, the machining tool 103 is mounted on the spindle 101 by, for example as shown in FIG. 15, putting into a collet 104 which is deformed by stress, and tightening a nut 105.

Recently, in small-diameter machining, further, machining at a higher precision and machining in a shorter time are demanded, and it is requested to develop a high-speed spindle capable of rotating at a high speed exceeding 200,000 rpm without any particular axial run-out. A machine tool having such high-speed spindle capable of rotating at super-high speed is capable of machining an extremely small part at high precision, and curtails the machining time and extends the tool life, and brings about outstanding merits.

[Patent document 1] Japanese Patent Application Laid-Open (JP-A) No. 11-13753, claim 1

However, the conventional high-speed spindle rotates at 80,000 rpm at most, and is far from satisfying the above requests. On the other hand, JP-A No. 11-13753 discloses a high-speed spindle, being a spindle incorporating a spindle rotation drive device in its inside, in which the spindle is supported by a pair of rolling elements making planetary motions on the guide surface in the housing at two positions in the axial direction, an air turbine for rotating holders is affixed between two rolling element holders of the holders for holding the rolling elements, and bearing for supporting the holders are provided on the outer circumference of the spindle or on the inner surface of the housing, but stable operation is not obtained at rotating speed exceeding 200,000 rpm even by using a speed-increasing device of high-speed spindle like this.

It is hence an object of the invention to provide a high-speed air spindle extremely small in axial run-out, and capable of rotating the spindle stably at a high speed exceeding 200,000 rpm.

SUMMARY OF THE INVENTION

The invention is intended to solve the problems of the prior art described above, and it is hence an object thereof to provide a high-speed air spindle comprising a spindle supported by a first bearing at the leading end side in the axial direction and a second bearing at the rear end side, a driving air turbine fixed in a spindle portion between the first bearing and the second bearing, a speed-increasing air turbine fixed in a spindle portion ahead of the first bearing, and an air passage of an exhaust of compressed air supplied in the driving air turbine, flowing in the sequence of the first bearing and the speed-increasing air turbine.

Effects of the Invention

According to the invention, the axial run-out is extremely small, and the spindle can be rotated at a high speed exceeding 200,000 rpm stably. Hence, in small-diameter machining, high precision machining is realized, and the machining time can be shortened. Moreover, the tool life is extended, the cost is reduced, and FA (factory automation) can be promoted.

DETAILED DESCRIPTION OF THE PREFERRED EMBODIMENTS

Figure 1:
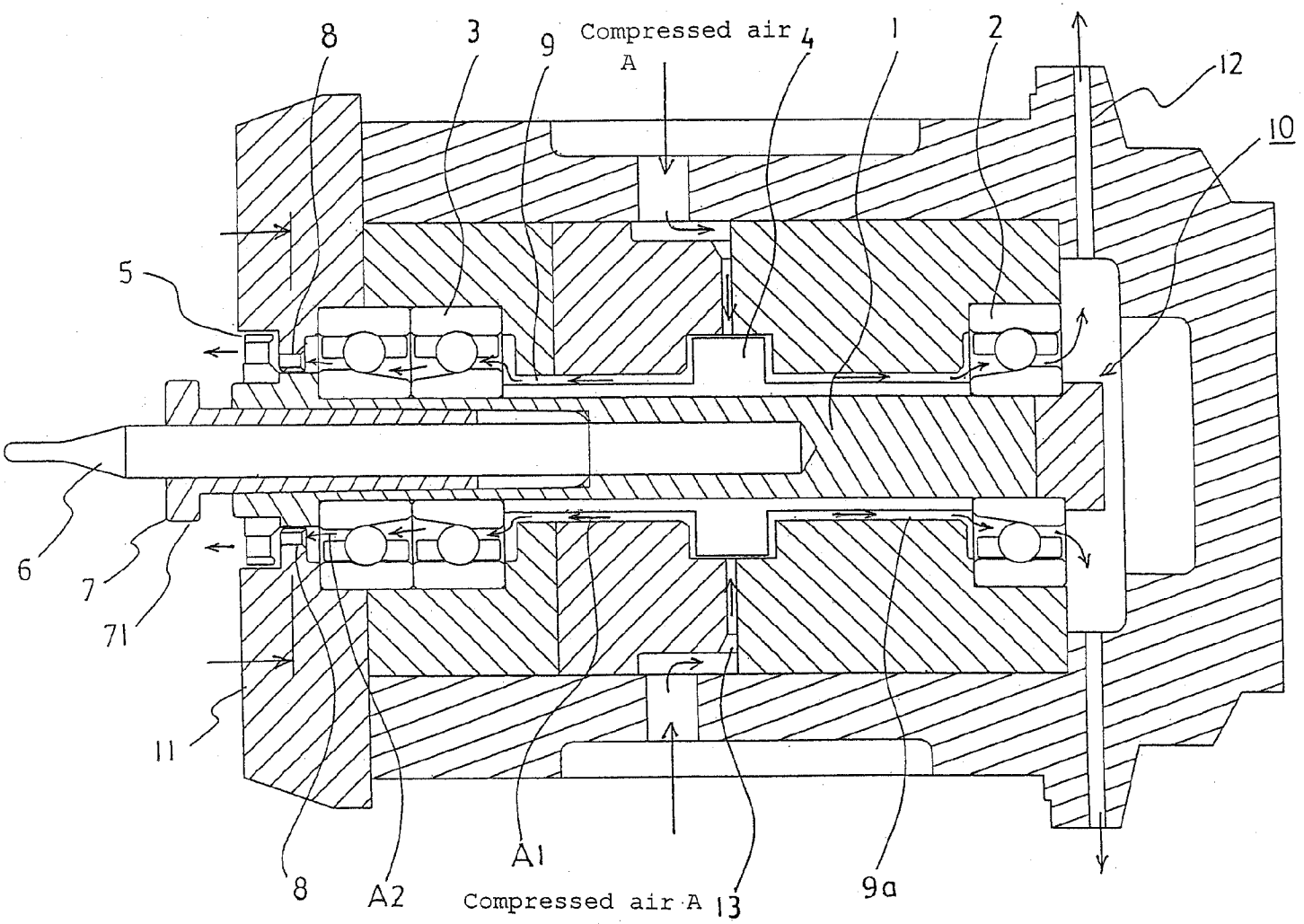
FIG. 1 is a drawing showing a structure of high-speed air spindle.
Figure 2:
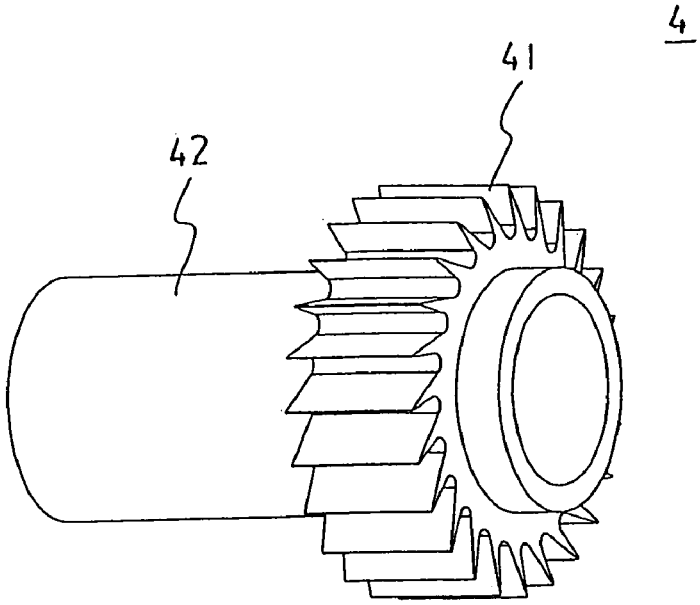
FIG. 2 is a perspective view of a driving air turbine used in the high-speed air spindle in FIG. 1.
Figure 3:
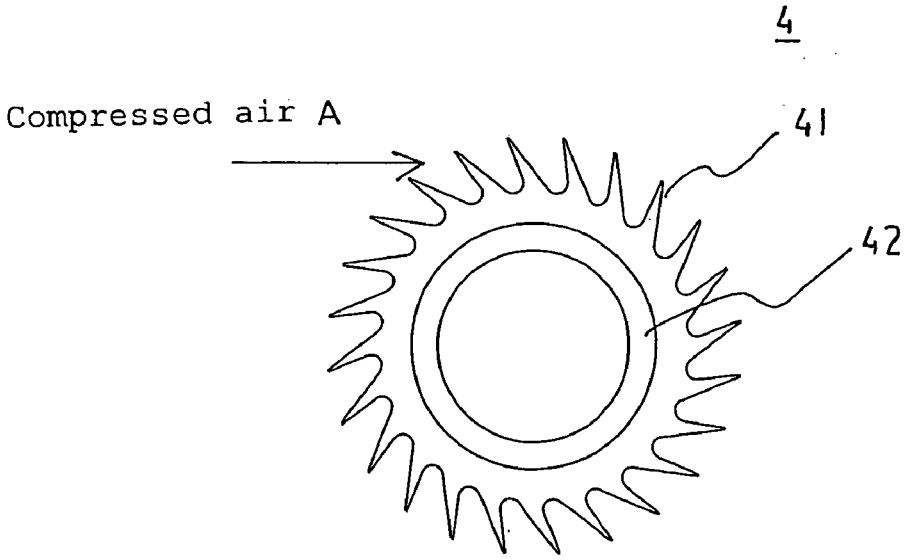
FIG. 3 is a side view of the driving air turbine in FIG. 2.
Figure 4:
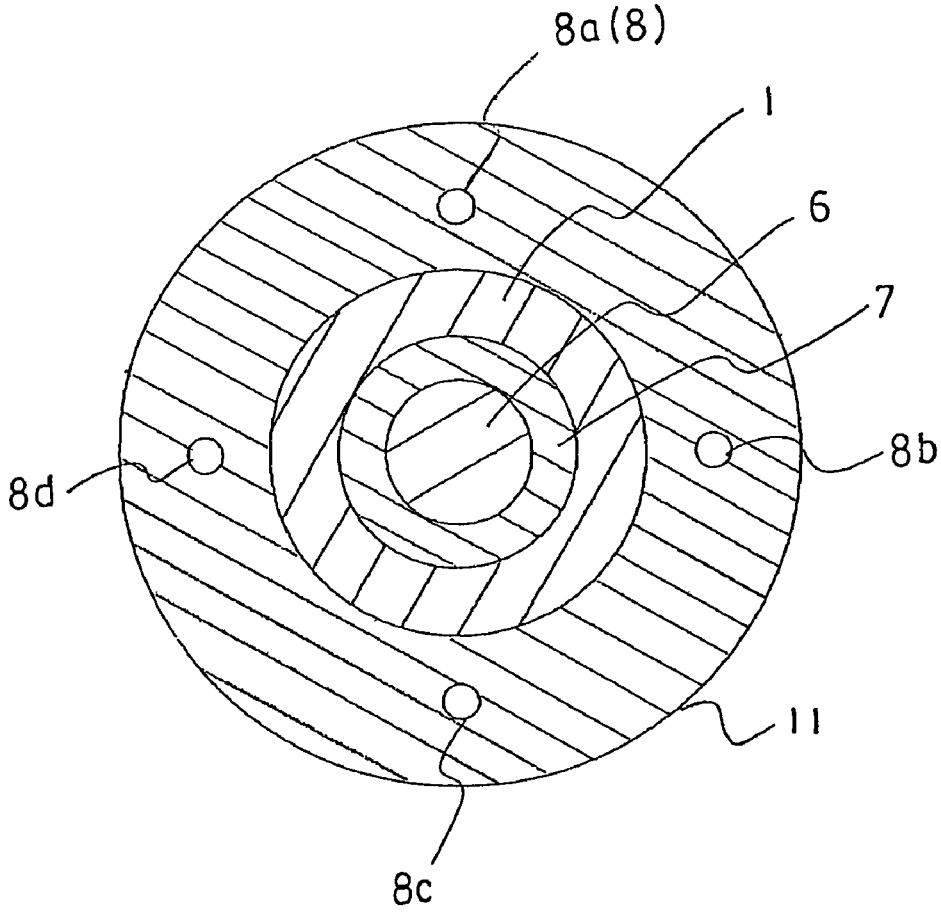
FIG. 4 is a view along line X-X in FIG. 1.
Figure 5:
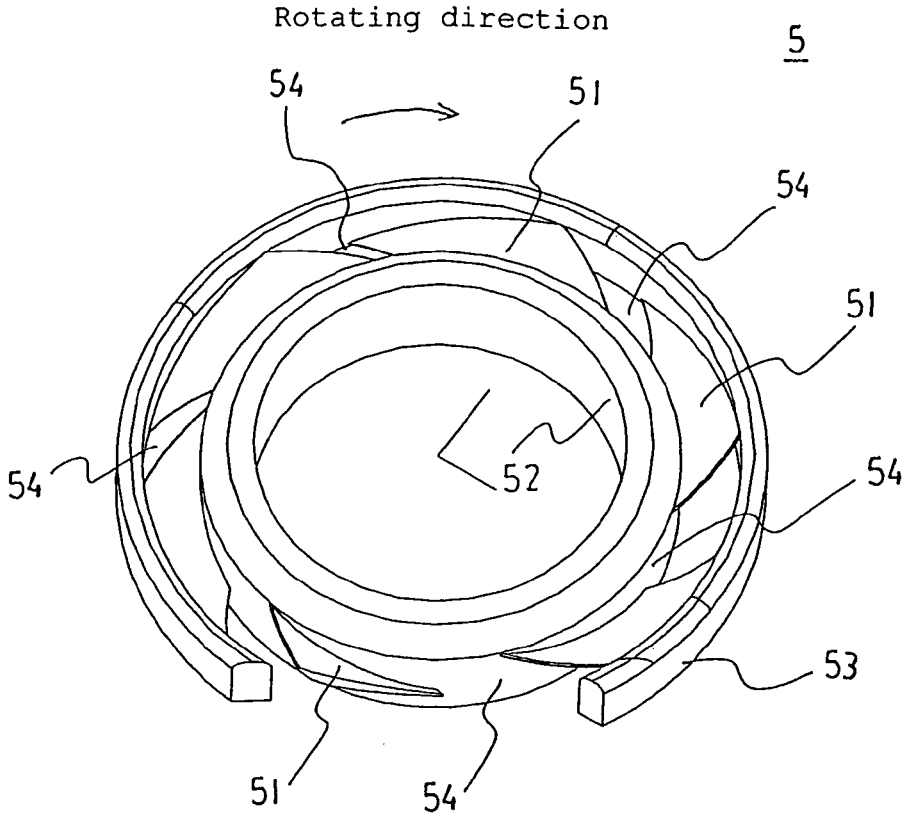
FIG. 5 is a partially cut-away perspective view of an axial-flow turbine used in the high-speed air turbine in FIG. 1.
Figure 6:
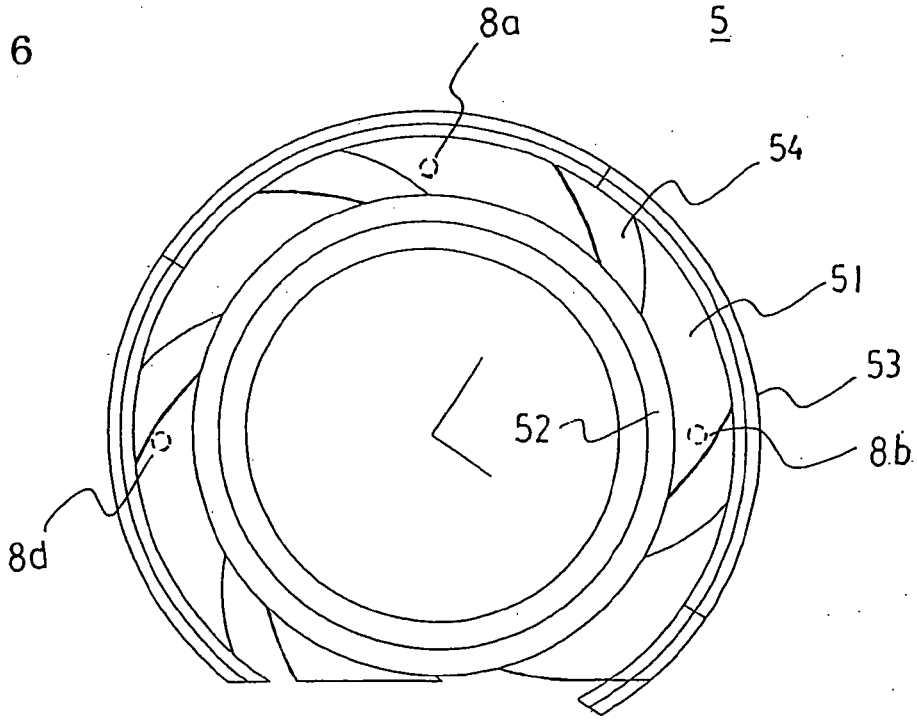
FIG. 6 is a plan view of the speed-increasing turbine in FIG. 5.
Figure 7:
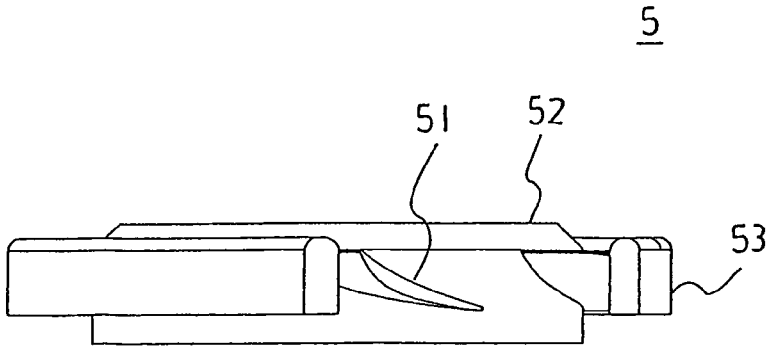
FIG. 7 is a front view of the speed-increasing turbine in FIG. 5.
Figure 8:
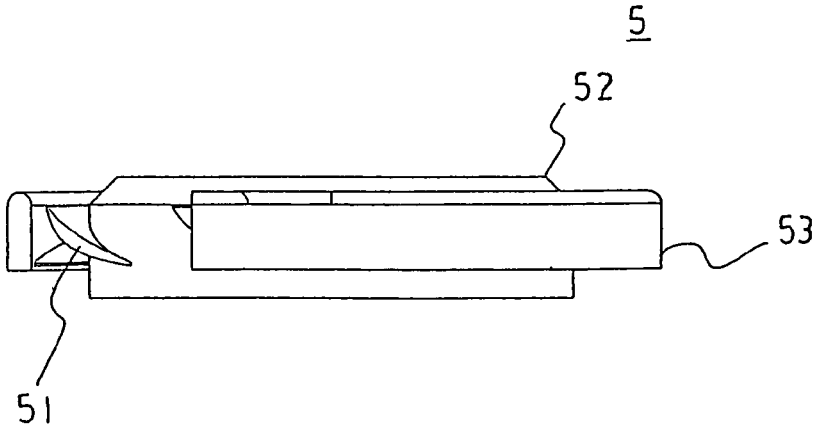
FIG. 8 is a side view of the speed-increasing turbine in FIG. 5.
Figure 9:
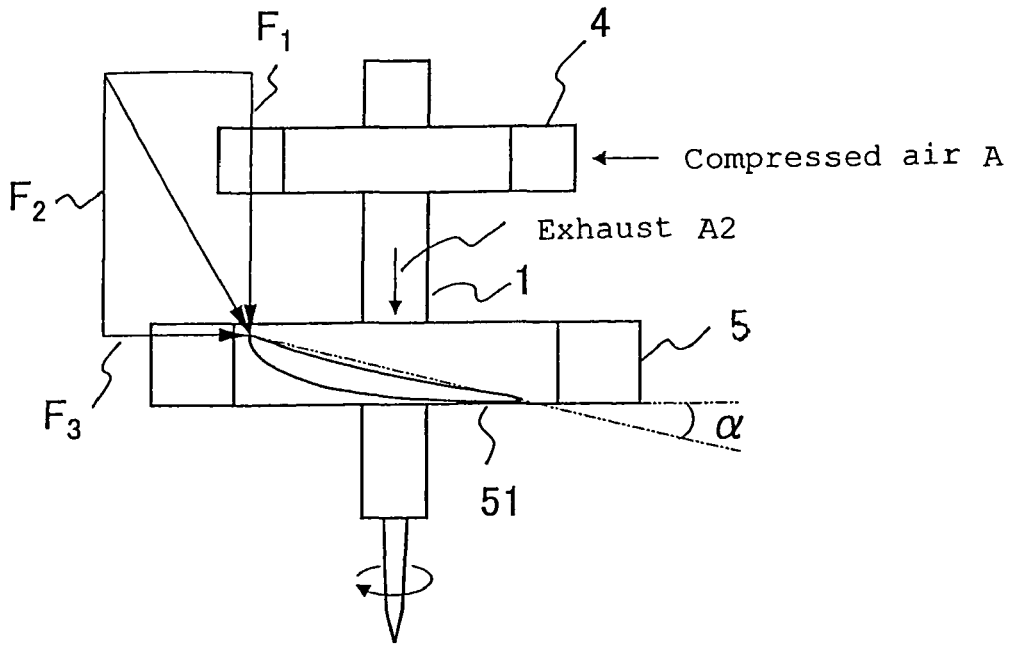
FIG. 9 is a diagram explaining the speed increasing effect of the speed-increasing turbine.

A high-speed air spindle in an embodiment of the invention is described below while referring to FIG. 1 to FIG. 9. FIG. 1 is a drawing showing a structure of high-speed air spindle, FIG. 2 is a perspective view of a driving air turbine used in the high-speed air spindle in FIG. 1, FIG. 3 is a side view of the driving air turbine in FIG. 2, FIG. 4 is a view along line X-X in FIG. 1, FIG. 5 is a partially cut-away perspective view of an axial-flow turbine used in the high-speed air spindle in FIG. 1, FIG. 6 is a partially cut-away plan view of the speed-increasing turbine in FIG. 5, FIG. 7 is a partially cut-away front view of the speed-increasing turbine in FIG. 5, FIG. 8 is a partially cut-away side view of the speed-increasing turbine in FIG. 5, and FIG. 9 is a diagram explaining the speed increasing effect of the speed-increasing turbine. In FIG. 1, the supply line of compressed air is omitted. Throughout the specification, the leading end side refers to the work piece side, and the rear side refers to the machine main body side.

A high-speed air spindle 10 includes a spindle 1 supported by a first bearing 3 at the leading end side in the axial direction and a second bearing 2 at the rear end side, a driving air turbine 4 fixed in a spindle portion between the first bearing 3 and the second bearing 2, a speed-increasing air turbine 5 fixed in a spindle portion ahead of the first bearing 3, and an air passage 9 of an exhaust A1 of compressed air supplied in the driving air turbine 4, flowing in the sequence of the first bearing 3 and the speed-increasing air turbine 5.

The driving air turbine 4 is not particularly specified as far as it has the action of impulse turbine in principle, and it is also called a radial-flow turbine, and it receives the compressed air A supplied from compressed air feed means not shown at its blades 41, and rotates the spindle 1. The driving air turbine 4 may be the same as used in the conventional air spindle. An example of the driving air turbine 4 is shown in FIG. 2 and FIG. 3, in which it consists of a cylindrical member 42 of a nearly same inside diameter as the outside diameter of the spindle 1 to be fitted to the spindle 1, and twenty-four blades 41 fixed on the cylindrical member 42. The blades 41 have a specified width extending parallel to the axial direction, and are inclined to the compressed air supply side. The conventional high-speed air spindle has such driving air turbine 4, but not have the speed-increasing air turbine 5, and the available rotating speed of the spindle 1 is about 130,000 rpm at most.

The speed-increasing air turbine 5 is an axial-flow turbine, and it receives the exhaust from the driving air turbine 4 at its blades 51, and rotates the spindle 1 at higher speed. The position of installation of the speed-increasing air turbine 5 is not limited to the position shown in FIG. 1, and it may be installed near a flange 71 of a collet 7 by extending the lead end of the spindle 1 to the further leading end side, or it may be installed directly on the flange 71 of the collet 7. In such a case, the position of an air discharge port 8 may be the same as shown in FIG. 1, but it is possible to be close to the blades 51 of the speed-increasing air turbine 5, so that the exhaust air may be utilized more efficiently.

The speed-increasing air turbine 5 consists of a ring-shaped inside retainer 52, a ring-shaped outside retainer 53, and six blades 51 provided in a space formed by the inside retainer 52 and the outside retainer 53, and openings 54 are formed between the adjacent blades 51. The openings 54 are exhaust ports for releasing the exhaust blown to the blades 51. The shape of the blades 51 is a slightly concave shape on the whole surface of the blades, being inclined downward from the rotating direction side to the anti-rotating direction side, and the shape of both ends in the circumferential direction, that is, the shape extending in the radial direction forms a part of the vortex shape. The downward inclination angle from the rotating direction side to the anti-rotating direction side of the blades, that is, the angle formed by the line linking the front end and rear end in the rotating direction of the blades and the direction orthogonal* to the spindle shaft (symbol $\alpha$ in FIG. 9) is in a range of 15.0 to 20.0 degrees, especially 17.0 to 18.4 degrees. The speed-increasing turbine 5 of the invention is not limited to this example, and, for example, the number of blades may be four or eight.

The air discharge port 8 for blowing the air A2 having cooled the first bearing 3 against the blades 51 of the speed-increasing air turbine 5 is provided in a plurality, four in this embodiment, in the fixed side housing 11 as shown in FIG. 4, at specified pitches in the circumferential direction, and as seen from the leading end side of the axial center in a stationary state, at least one, preferably two, more preferably three, or most preferably all of them are located at unseen positions concealed by the blades 51. For example, in FIG. 6, all of the four air discharge ports 8 (8*a* to 8*d*) are concealed by the blades 51, and are not visible. In FIG. 6, the air discharge port 8*c* is not shown because the pertinent part is omitted, but from the projection line it is evident to be located at a position concealed by the blades 51. By such configuration of the air discharge ports 8 and the blades 51, the air discharged from the air discharge ports 8 during high-speed rotation always hits against any one of the blades 51, so that the exhaust from the driving air turbine 4 may be utilized efficiently.

The number of air discharge ports 8 is not limited to four, but may be determined appropriately. The total cross sectional area of the openings of the air discharge ports 8 is 3.0 to 4.0 $mm^2$. If the total cross sectional area of the openings of the air discharge ports 8 is too small, enough flow velocity of the exhaust for increasing the speed sufficiently for the speed-increasing air turbine 5 is not obtained, and the bearing temperature may rise to cause bearing breakdown. If too much, to the contrary, the flow rate of compressed air supplied from a plurality of feed ports 13 may fluctuate, which is undesirable as rotation is not efficient.

The flow velocity of the exhaust from the air discharge ports is preferably 150 m/s or more, and more preferably 190 m/s or more. If the flow velocity of the exhaust is less than 150 m/s, the speed-increasing air turbine 5 cannot be rotated at higher speed, and the spindle rotation hardly reaches 200,000 rpm. The flow velocity of the exhaust is preferably as high as possible, but the upper limit pressure of the air compressor used in most machine tools is about 0.85 MPa, and the air pressure supplied to the spindle is about 0.45 MPa, and in this condition the exhaust flow velocity is about 250 m/s.

The first bearing 3 and the second bearing 2 for supporting the spindle 1 may be both angular ball bearings. The angular ball bearings are preferred because the composite load of axial load and radial load can be supported. Since the angular ball bearings have a contact angle, when an angular load acts, an axial partial force is generated. Accordingly, as in the first bearing 3, preferably, two single-row angular ball bearings are combined in back-to-back pair for use.

In the high-speed air turbine 10 of the invention, the exhaust A1 of the compressed air A supplied in the driving air turbine 4 flows in the sequence of the first bearing 3 and the speed-increasing air turbine 5 in a first air passage 9, and the exhaust A1 of the compressed air A supplied in the driving air turbine 4 flows in the sequence of the second bearing 2 in a second air passage 9*a*. The compressed air A is usually supplied from a plurality of feed ports 13 formed at specified pitches in the circumferential direction of the driving air turbine 4, and injecting at about a right angle to the blades 41 of the driving air turbine 4. The first air passage 9 and the second air passage 9*a* are formed across an annular gap between the circumferential surface of the blades 41 and cylindrical member 42 of the driving air turbine 4, and the inner circumferential surface of the housing, and near the both sides of the bearing direction of the first bearing 3 and the second bearing 2, the annular shape is expanded to a diameter including the ball support parts of the bearings. In the first air passage 9, the exhaust A2 after cooling the first bearing 3 passes through the air discharge ports 8, and is blown to the blades of the speed-increasing air turbine 5. In the second air passage 9*a*, the exhaust after cooling the second bearing 2 passes through an exhaust duct 12, and is exhausted outside.

Figure 11A:
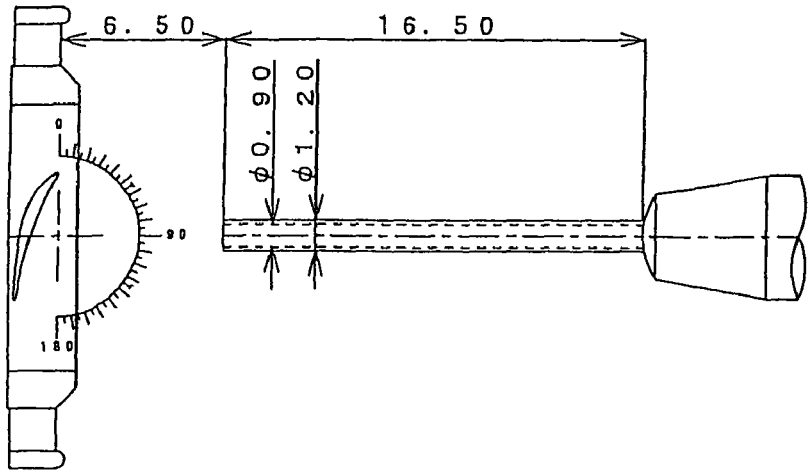
FIG. 11 (A) is a schematic diagram showing the positional relation between the nozzle of the measuring instrument shown in FIG. 10 and the angle of attack of turbine of 90 degrees, and (B) is a schematic diagram showing the positional relation between the nozzle of the instrument and the speed-increasing air turbine.
Figure 11B:
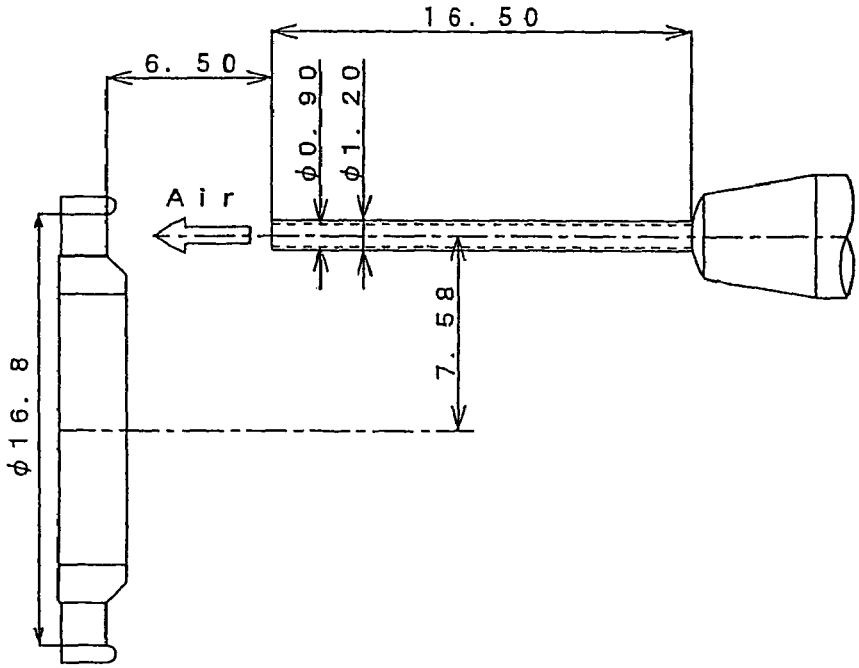

In the high-speed air turbine 10 of the invention, the method of mounting the machining tool 6 on the spindle 1 is not particularly specified, and, for example, as shown in FIG. 11, the tool is mounted by using a collet 104 and a nut 105, the tool itself is press-fittedly tapered and is directly press-fitted into the spindle (direct press-fitting method), the tool is set to the spindle by shrinkage fitting, and the shrinkage-fit collet is press-fitted into the spindle (shrinkage-fit collet press-fitting method). In particular, the direct press-fitting method or shrinkage-fit collet press-fitting method is preferred, and the shrinkage-fit collet press-fitting method is particularly preferable. That is, by the direct press-fitting method or shrinkage-fit collet press-fitting method, as compared with the method of using the nut, there is no threaded part, and the rotation balance is stabilized, and the leading end is not particularly heavy, and the axial run-out hardly occurs, the mounting error is small, and the number of parts can be curtailed. The shrinkage-fit collet is prepared by heating the collet to increase the fitting hole size by thermal expansion, and inserting the tool into this fitting hole, and cooling the collet. To mount the shrinkage-fit collet on the spindle 1, a slightly tapered inner hole wider at the leading end is formed in the spindle 1, and the shrinkage-fit collet is press-fitted in this hole. The state after assembling the shrinkage-fit collet is shown in FIG. 1.

The machining tool used in the high-speed air turbine 10 of the invention includes a cutting tool and a grinding tool. In the case of a small-diameter machining by using a cutting tool, the tool diameter is preferably 0.03 mm at minimum, and the tool may be used stably. In the case of a conventional air turbine, if the tool diameter is 0.1 mm, the axial run-out rigidity of the spindle is insufficient, and the tool may be broken. Or high-precision cutting and machining is difficult. If a material of high hardness is machined by using a spindle lacking in rigidity, the displacement amount in the Z-direction or the displacement amount in the rotating direction increases. Small-diameter machining is required, for example when cutting and machining a die for portable telephone or camera having a small diameter part of 0.1 mm or less in the fillet or width.

Next, the mechanism of high-speed rotation of the high-speed air spindle 10 assembled as shown in FIG. 1 is explained. First, compressed air A is supplied into the driving air turbine 4. Hence, the spindle 1 is put into rotation. The exhaust A1 from the driving air turbine 4 passes through the first air passage 9, and cools the bearing area of the first bearing 3. The exhaust A2 after cooling the bearing area of the first bearing 3 is guided into the speed-increasing air turbine 5 by way of the air discharge port 8, and further rotates the speed-increasing air turbine 5 at high speed. The air blowing out along the surface of the blades 51 of the speed-increasing air turbine 5 is exhausted from the openings 54 of the speed-increasing air turbine 5.

Referring now to FIG. 9, the reason of achieving a high-speed rotation of 200,000 rpm of the spindle 1 of the high-speed air spindle 10 is explained. The spindle 1 is driven by the driving air turbine 4 at a speed of 90,000 to 130,000 rpm. In this state, the exhaust A2 (F2) from the bearing area of the first bearing 3 is supplied into the speed-increasing air turbine 5 from the axial direction. In the speed-increasing air turbine 5, also, a wind force F3 in the lateral direction is generated due to effects of rotation by starting of the driving air turbine 4. As a result, a combined force F1 of the exhaust force F2 and the wind force F3 in lateral direction is generated in the speed-increasing air turbine 5, and it is efficiently utilized in rotation of the speed-increasing air turbine. That is, the rotating speed of the spindle 1 is the sum of the additional rotating speed generated by the combined force F1, and the rotating speed by driving of the driving air turbine 4. Thus, by combination of the driving air turbine 4 and the speed-increasing air turbine 5, a stable rotating speed as high as 200,000 rpm not achieved before can be reached. Meanwhile, if the speed-increasing air turbine 5 is installed between the first bearing 3 and the driving air turbine 4, such high speed is not obtained. Incidentally, in the case of a spindle for dental use, a high speed surpassing 300,000 rpm may be obtained, but the axial run-out is significant, and since the bearing is small, a cutting tool cannot be mounted physically, and it is not applicable to precision machining.

By using a machine tool having such high-speed air spindle of the invention, for example, when a precision die is manufactured, although impossible previously, a high-precision machining can be done in a short time at plane precision of 1 μm or less. At the same time, the tool life can be extended.

The invention is more specifically described below by presenting examples, but these examples are provided for purposes of illustration and the invention is not limited to these examples alone.

Example 1

A machine tool having a configuration as shown in FIG. 1, and incorporating a high-speed air spindle in the following specification was operated in the following conditions, and the rotating speed of the spindle was measured. As a result, the rotating speed of the spindle was 200,000 rpm.

<Compressed Air>

- Compressed air pressure supplied from air compressor: 0.45 MPa
- Number of nozzles to blow into the driving air turbine: 6
- Discharge amount of compressed air blown from the nozzles to the driving air turbine: 18.75 liters/min/nozzle <High-Speed Air Spindle>

- First bearing and second bearing: angular ball bearing 8BGR10X (manufactured by NSK Ltd.)
- Driving air turbine: impulse turbine shown in FIG. 2 (24 blades)
- Speed-increasing air turbine: axial-flow turbine shown in FIG. 5 to FIG. 8 (6 blades)
- Blade inclination angle (angle formed by linking line of front end and rear end in rotating direction of blades and line orthogonal to spindle shaft): 17.7 degrees
- Air exhaust port: air discharge port shown in FIG. 4 (4 ports)
- Aperture of air discharge port: 1.0 mm
- Total cross sectional area of air discharge ports: 3.14 $mm^2$
- Flow velocity of exhaust blown from air discharge ports: 194.38 m/s
- Flow rate of exhaust blown from air discharge ports: 62.79 liters/min The flow velocity of exhaust blown from air discharge ports is the value measured by dismounting the speed-increasing air turbine. The flow velocity and flow rate of the exhaust were measured by using TA10 thermal type wind velocity sensor TA10-285GE-200M/S (manufactured by Hertz) and sensor separate type U10a transformer TA10 (manufactured by Hertz).

<Measuring Method of Rotating Speed>

The rotating speed of the spindle is measured by using photoelectric type tachometer LBT15TA (measuring range 0 to 300,000 rpm) (manufactured by Sugawara Laboratories Inc.).

Examples 2 and 3

The rotating speed of the spindle was measured in the same method as in example 1, except that the compressed air pressure was changed from 0.45 MPa to 0.50 MPa (example 2), or 0.55 MPa (example 3). The results were respectively 210,000 rpm and 260,000 rpm.

<Verification Experiments of Installation Effects of Speed-Increasing Air Turbine>

(Experiment 1: effects of supply angle (angle of attack of turbine) of compressed air (virtual exhaust) on rotating speed of speed-increasing air turbine)

Figure 10:
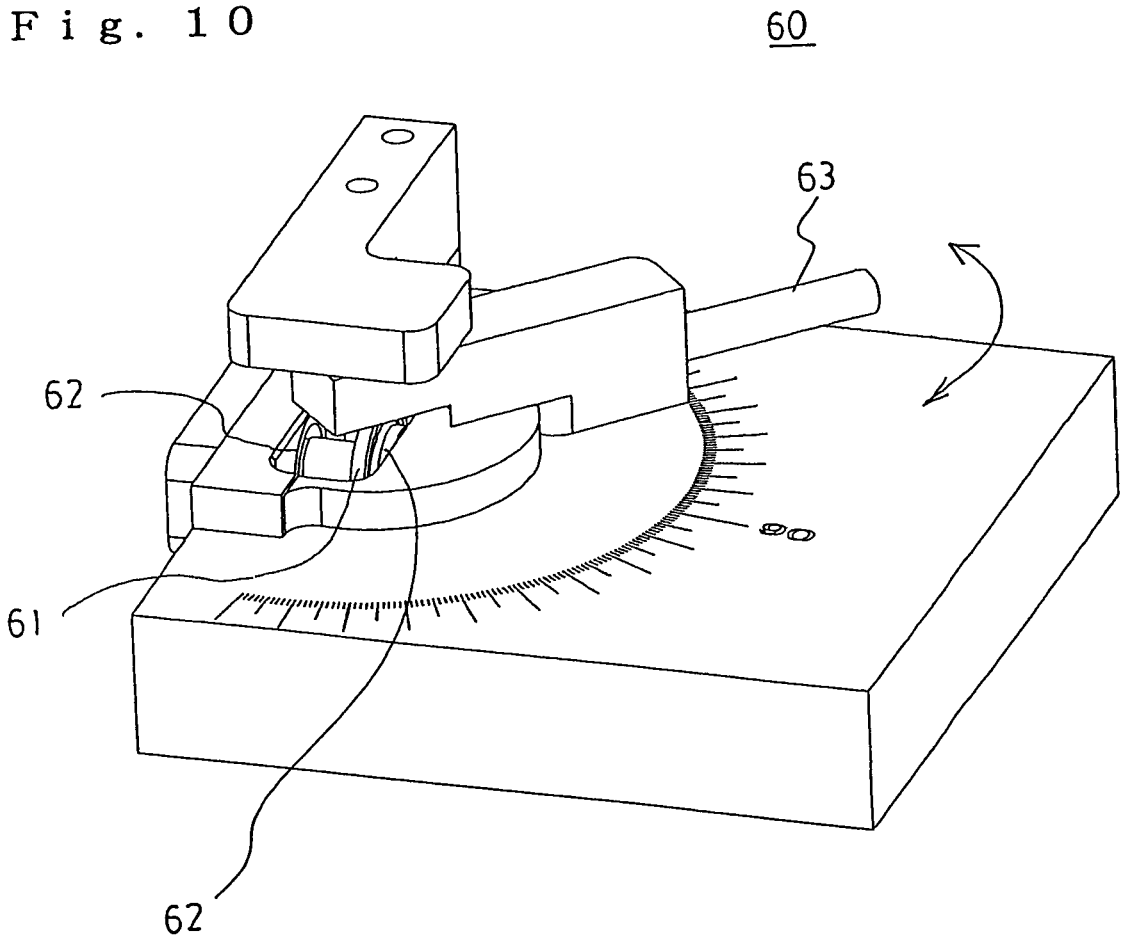
FIG. 10 is a perspective view of a measuring instrument provided with an angle detector.
Figure 12:
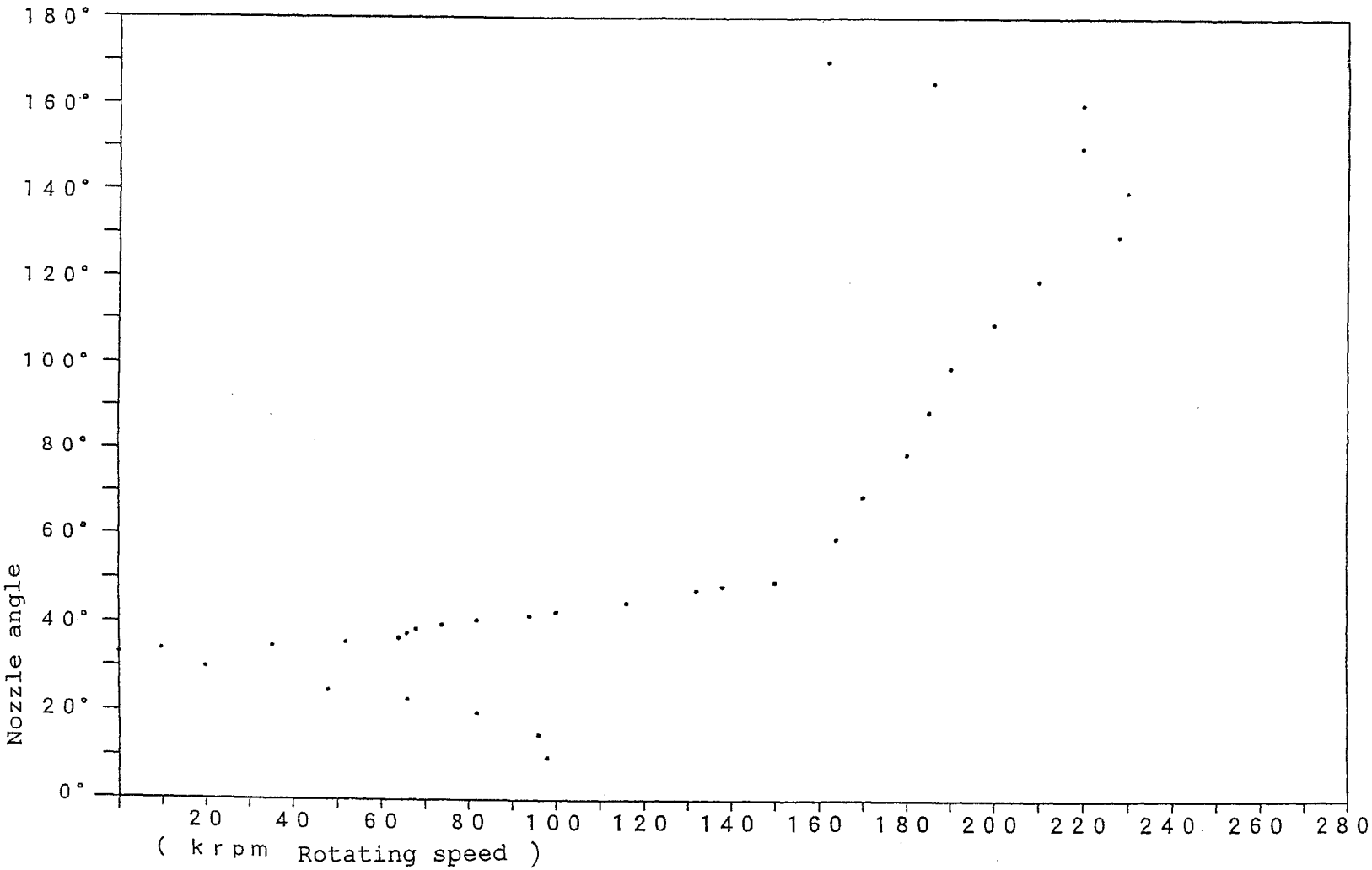
FIG. 12 is a diagram showing the effect of nozzle angle (angle of attack of turbine) on the rotating speed of the speed-increasing air turbine.
Figure 14:
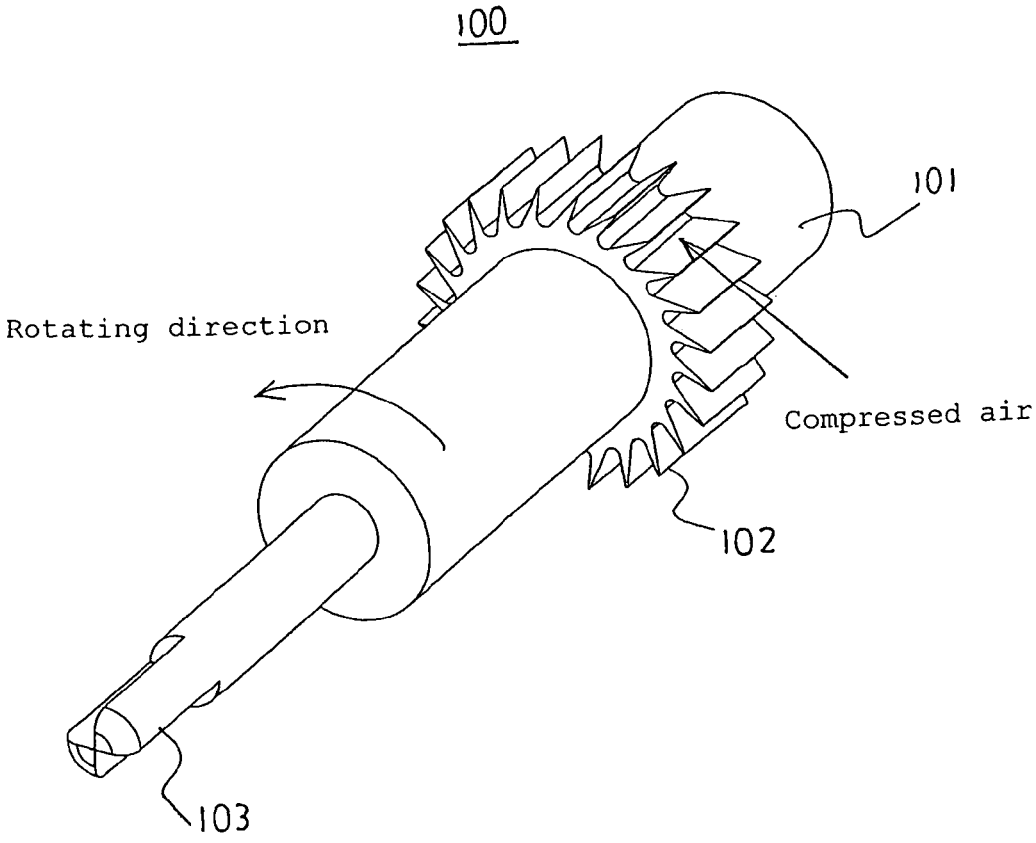
FIG. 14 is a simplified diagram showing a part of a conventional air spindle.
Figure 15:
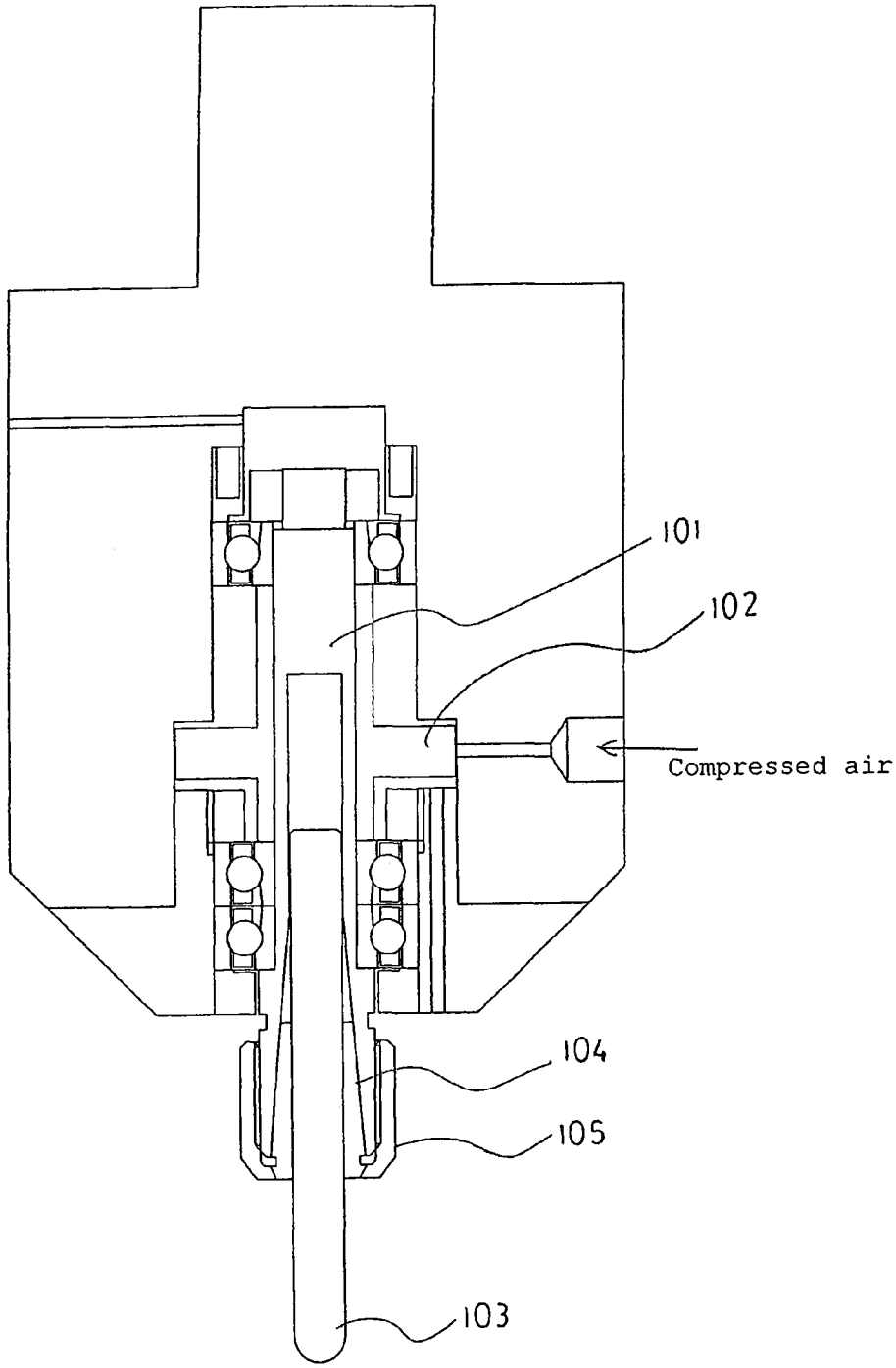
FIG. 15 is a diagram explaining the mounting method of machining tool on a conventional spindle.

Using a measuring instrument provided with an angle detector in the following specification shown in FIG. 10 and FIG. 11, effects of angle of attack of turbine (shown as nozzle angle in FIG. 12) of compressed air on the rotating speed of the speed-increasing air turbine were measured. Results are shown in FIG. 12. FIG. 11 (A) is a schematic diagram showing the positional relation between the nozzle of the measuring instrument shown in FIG. 10 and the angle of attack of turbine of 90 degrees, and (B) is a schematic diagram showing the positional relation between the nozzle of the instrument and the speed-increasing air turbine. That is, a measuring instrument with angle detector 60 has a speed-increasing air turbine 61 supported by a bearing 62 incorporated at its leading end, and is provided with a nozzle 63 freely rotatable in a range of 0 to 180 degrees relatively to the speed-increasing air turbine 61 (see FIG. 10).

(Specification of Measuring Instrument)

Speed-increasing air turbine: axial-flow turbine used in example 1

Bearing: NSK-MR63 (4 miniature ball bearings) (manufactured by NSK Ltd.)

Supply air pressure: 0.45 MPa

As clear from FIG. 12, from the nozzle angle of 35 degrees, the rotation of speed-increasing air turbine in the normal direction of handedness was started, and the rotating speed continued to increase up to 140 degrees and reached the maximum of 230,000 rpm, and began to decelerate after 140 degrees. Accordingly, to rotate the speed-increasing air turbine effectively, an appropriate range of angle of attack of turbine is known to be 120 degrees to 160 degrees. The rotation up to the nozzle angle of 35 degrees is a rotation in the reverse direction of handedness.

Verification of Example 1

Figure 13:
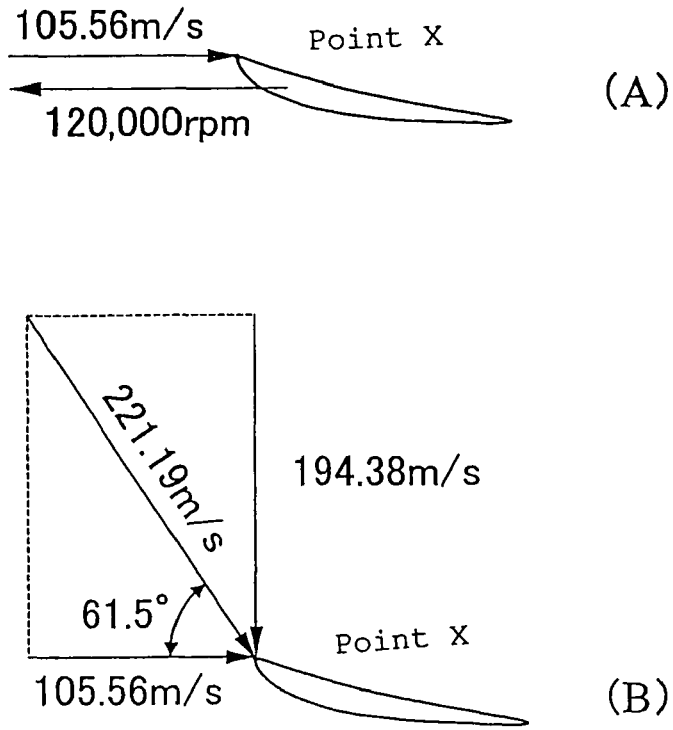
FIG. 13 is a diagram explaining the verification of example 1.

In the high-speed air spindle in experiment 1, the speed-increasing air turbine was dismounted, and the rotating speed at supply air pressure of 0.45 MPa was 120,000 to 126,000 rpm. By mounting the speed-increasing air turbine, when started at the supply air source of 0.45 MPa, the rotating speed obtained in the speed-increasing air turbine is 120,000 rpm, and as shown in FIG. 13 (A), at point X of the speed-increasing air turbine, a maximum wind pressure of 105.6 m/s ((16.8 mm×circle ratio×120,000)/60) is received from the rotating direction. At this time, the flow velocity of the exhaust blown out from the air discharge ports is 194.38 m/s (measured value), and at point X of the speed-increasing air turbine, a wind pressure in two directions is received. The combined flow velocity of wind pressures in two directions is 221.2 m/s, and the flow-in angle of combined flow velocity into the speed-increasing air turbine (angle of attack) is 61.5 degrees (FIG. 13). From the graph in FIG. 12, the additional rotating speed of the speed-increasing air turbine at the nozzle angle of 61.5 degrees is 170,000 rpm. Hence, the total rotating speed of 120,000 rpm and 170,000 rpm is 290,000 rpm. The reason why this verification result of 290,000 rpm is different from the actual measured value of 200,000 rpm is that the graph in FIG. 12 is a dummy test including experimental conditions different from example 1, that the blade surface of the speed-increasing air turbine is actually in a turbulent state, and that the bearings in example 1 are larger than the bearings used in the verification test of installation effect of the speed-increasing air turbine and hence involve a bearing resistance.

Example 4

<Fabrication of Die>

In high-speed rotation at the level of 200,000 rpm, it is difficult to measure the axial run-out in micron order because of influence by gyro effect or vibration. Accordingly, a cutting tool of diameter of 0.1 mm was mounted on the high-speed air spindle of example 1, and at rotation of 200,000 rpm, a die for a portable telephone having a piece of small diameter of 0.1 mm was actually cut and evaluated. The cutting tool was set on the collet, and the collet was fitted to the spindle by shrinkage fitting method. As a result, the cutting tool was not broken, and a die of desired shape could be fabricated at high precision.

Comparative Example 1

Cutting and machining was attempted in a same method as in example 4, except that the high-speed air spindle was replaced by a conventional spindle without a speed-increasing air turbine, that the spindle rotating speed of 200,000 rpm was changed to 100,000 rpm, and that the tool was tightened by the nut instead of the shrinkage fitting method. As a result, the cutting tool was broken in the process of cutting a piece of small diameter. The causes were axial run-out of the air spindle, and lack of rotation.

What is claimed is:

1. A high-speed air spindle comprising:

a spindle supported by a first bearing at the leading end side in the axial direction and a second bearing at the rear end side, a driving air turbine fixed in a spindle portion between the first bearing and the second bearing, a speed-increasing air turbine fixed in a spindle portion ahead of the first bearing, and an air passage of an exhaust of compressed air supplied in the driving air turbine, flowing in the sequence of the first bearing and the speed-increasing air turbine.

2. The high-speed air spindle of claim 1, wherein the driving air turbine is an impulse turbine.

3. The high-speed air spindle of claim 1, wherein the speed-increasing air turbine is an axial-flow turbine.

4. The high-speed air spindle of claim 1, wherein a plurality of air discharge ports for blowing the air having cooled the first bearing to blades of the speed-increasing turbine are disposed in a fixed side housing at specified pitches in the circumferential direction, and at least one of the air discharge ports as seen from the leading end side in the axial center in a stationary state is provided at an unseen position concealed by the blades.

5. The high-speed air spindle of claim 4, wherein the flow velocity of the exhaust discharged from the air discharge ports is 150 m/s or more.

6. The high-speed air spindle of claim 1, wherein the first bearing and the second bearing are angular ball bearings.

7. The high-speed air spindle of claim 1, wherein a machining tool is mounted on the leading end of the spindle.

* * * * *